US009573709B2

(12) United States Patent
Chapman et al.

(10) Patent No.: US 9,573,709 B2
(45) Date of Patent: Feb. 21, 2017

(54) INTER-MACHINE BUFFER FOR MAILPIECE FABRICATION SYSTEM

(75) Inventors: Carl L. Chapman, Monroe, CT (US); Arthur H. DePoi, Brookfield, CT (US); Boris Rosenfeld, Danbury, CT (US); John R. Masotta, Newtown, CT (US); Aris Ballestrazzi, Savignano s.P. (IT)

(73) Assignee: Pitney Bowes Inc., Stamford, CT (US)

( * ) Notice: Subject to any disclaimer, the term of this patent is extended or adjusted under 35 U.S.C. 154(b) by 628 days.

(21) Appl. No.: 14/113,973

(22) PCT Filed: Jun. 1, 2012

(86) PCT No.: PCT/US2012/040422

§ 371 (c)(1),
(2), (4) Date: Dec. 5, 2013

(87) PCT Pub. No.: WO2012/167050

PCT Pub. Date: Dec. 6, 2012

(65) Prior Publication Data

US 2014/0150378 A1 Jun. 5, 2014

Related U.S. Application Data

(60) Provisional application No. 61/492,987, filed on Jun. 3, 2011.

(51) Int. Cl.
*B65B 11/48* (2006.01)
*B65B 11/00* (2006.01)
(Continued)

(52) U.S. Cl.
CPC ..... *B65B 11/00* (2013.01); *B43M 5/04* (2013.01); *B65B 57/02* (2013.01); *B65B 9/06* (2013.01)

(58) Field of Classification Search
CPC ..... B31B 19/26; B31B 2221/05; B25B 11/00; B65B 57/02; B65B 9/06; B43M 5/04
See application file for complete search history.

(56) References Cited

U.S. PATENT DOCUMENTS 4,939,888 A * 7/1990 Katz ..... B31B 41/00 270/4
5,107,656 A * 4/1992 Katz ..... B31B 41/00 53/131.4

(Continued)

FOREIGN PATENT DOCUMENTS

EP 0899129 A2 3/1999
WO WO 92/00676 A1 1/1992

*Primary Examiner* — Andrew M Tecco
(74) *Attorney, Agent, or Firm* — Steven J. Shapiro; Charles R. Malandra, Jr.

(57) ABSTRACT

A system and method for wrapping sheet material to produce finished mailpieces includes an upstream content module, a downstream mailpiece assembly module including a wrapper module adapted to encapsulate content material, and a buffer module interposing the upstream content and downstream assembly modules. The buffer module includes a plurality of buffer gates adapted to convey the content material from an upstream gate to a downstream gate to maintain a threshold pitch distance between successive pieces of content material. A controller is operatively coupled to the modules and controls the conveyance of content material through the buffer gates. More specifically, the controller coordinates the delivery and insertion of content material into the wrapper module to minimize dry-holes, maintain stresses below a threshold level to ensure continued operation, and optimize system throughput.

13 Claims, 4 Drawing Sheets

(51) Int. Cl.

| | |
|---|---|
| ***B65B 57/02*** | (2006.01) |
| ***B43M 5/04*** | (2006.01) |
| *B65B 9/06* | (2012.01) |

(56) References Cited

U.S. PATENT DOCUMENTS

| | | | | |
|---|---|---|---|---|
| 5,155,973 | A * | 10/1992 | Hipko | B43M 5/04 53/450 |
| 5,524,421 | A | 6/1996 | Nauheimer | |
| 6,687,570 | B1 * | 2/2004 | Sussmeier | B65H 9/004 270/52.09 |
| 2006/0156876 | A1 | 7/2006 | Sussmeier | |
| 2006/0186592 | A1 | 8/2006 | Stemmle | |
| 2009/0107086 | A1 | 4/2009 | Keane | |
| 2010/0156042 | A1 | 6/2010 | Ifkovits | |

* cited by examiner

INTER-MACHINE BUFFER FOR MAILPIECE FABRICATION SYSTEM

CROSS REFERENCE TO RELATED APPLICATIONS

This application claims priority under 35 U.S.C. section 119(e) from Provisional Patent Application Ser. No. 61/492,987, filed Jun. 3, 2011, entitled Mailpiece Buffer for Mailpiece Wrapping System, and PCT International Application No. PCT/US2012/040422, entitled Inter-Machine Buffer for Mailpiece Fabrication System, by Carl R. Chapman, et al., which are both incorporated herein by reference in their entirety.

TECHNICAL FIELD

The present invention relates to mailpiece creation systems, and, more particularly, to a new and useful inter-machine buffer interposing a chassis and wrapper module of a mailpiece fabrication system to ensure matched-mailing of the content with the external wrap of a pre-printed web of sheet material.

BACKGROUND OF THE INVENTION

Mailpiece creation systems such as mailpiece inserters and mailpiece wrappers are typically used by organizations such as banks, insurance companies, and utility companies to periodically produce a large volume of mailpieces, e.g., monthly billing or shareholders income/dividend statements. In many respects, mailpiece inserters are analogous to automated assembly equipment inasmuch as sheets, inserts and envelopes are conveyed along a feed path and assembled in or at various modules of the mailpiece inserter. That is, the various modules work cooperatively to process the sheets until a finished mailpiece is produced.

Mailpiece inserters include a variety of apparatus/modules for conveying and processing a substrate/sheet material along the feed path. Commonly mailpiece inserters include apparatus/modules for (i) feeding and singulating printed content in a "feeder module", (ii) accumulating the content to form a multi-sheet collation in an "accumulator", (iii) folding the content to produce a variety of fold configurations such as a C-fold, Z-fold, bi-fold and gate fold, in a "folder", (iv) feeding mailpiece inserts such as coupons, brochures, and pamphlets, in combination with the content, in a "chassis module" (v) inserting the folded/unfolded and/or nested content into an envelope in an "envelope inserter", (vi) sealing the filled envelope in "sealing module" and (vii) printing recipient/return addresses and/or postage indicia on the face of the mailpiece envelope at a "print station".

In lieu of a module for inserting the content material into an "envelope", some mailpiece creation systems employ a wrapping system operative to encapsulate the mailpiece content in an outer wrapping material. While such wrapping systems offer a low-cost alternative to those which employ conventional pre-fabricated mailpiece envelopes, wrapping systems of the prior art have generally been limited to those using plastic materials, rather than paper-based materials, to wrap the content. Wrapping systems of the type described herein are produced by Sitma Machinery S.p.A. located in Spilamberto, Italy, a world class leader in mailpiece finishing systems.

Attempts to employ paper-based wrapping materials have been limited by an inability to produce "matched mailpieces". That is, wrapping systems of the prior art, have been unable to "match" content intended for a specific recipient with an envelope having the recipient's destination address pre-printed on the exterior of the envelope. Such difficulties have arisen, at least in part, due to the inability to start/stop the web of wrapping material, i.e., a system with a large inertial mass, with the agility necessary to coordinate with a relatively nimble content creation system at the upstream end of the wrapping system. As a consequence, such wrapping systems have typically used "windowed" wrap material to allow a destination address of the content to be viewable through the wrapping material.

It is, therefore, the object of the present invention to provide a mailpiece fabrication system which successfully integrates a downstream mailpiece wrapping system with high-throughput content fabrication equipment.

SUMMARY OF THE INVENTION

A system and method for wrapping sheet material to produce finished mailpieces includes an upstream content module, a downstream mailpiece assembly module including a wrapper module adapted to encapsulate content material, and a buffer module interposing the upstream content and downstream assembly modules. The buffer module includes a plurality of buffer gates adapted to convey the content material from an upstream gate to a downstream gate to maintain a threshold pitch distance between successive pieces of content material. A controller is operatively coupled to the modules and controls the conveyance of content material through the buffer gates. More specifically, the controller coordinates the delivery and insertion of content material into the wrapper module to minimize dry-holes, maintain stresses below a threshold level to ensure continued operation, and optimize system throughput.

BRIEF DESCRIPTION OF THE DRAWINGS

The accompanying drawings illustrate presently preferred embodiments of the invention and, together with the general description given above and the detailed description given below serve to explain the principles of the invention. As shown throughout the drawings, like reference numerals designate like or corresponding parts.

DETAILED DESCRIPTION OF THE INVENTION

The present invention is directed to a system and method for integrating an upstream mailpiece content mailpiece wrapping system with content creation systems modules typically employed in mailpiece inserters wherein content is inserted into a dedicated mailpiece envelope. While the invention is described in the context of a paper-based wrapping system, i.e., a system which is fed by a paper web, for creating finished mailpieces, the invention is equally applicable to wrapping systems which employ plastic wrapping materials to encapsulate mailpiece content. Consequently, the detailed description and illustrations are merely indicative of an embodiment of the invention, and, accordingly, the invention should be broadly interpreted in accordance with the appended claims.

The following detailed description will be facilitated by the definition of several terms of art used to describe mailpiece fabrication systems. For example, the "pitch" of a mailpiece creation system is the distance between the leading/trailing edge of one piece of content material and the leading/trailing edge of an adjacent piece of content material along the conveyance feed path. A "cycle" relates to the time required to process one mailpiece, but is measured in distance. In the described embodiment, the distance that a piece of content material 12 travels in one cycle is about 250 millimeters, or 0.250 meters. The "throughput" of a mailpiece creation system is defined as the number of mailpieces produced/unit of time. A high-output mailpiece creation system will produce between 10,000 to 26,000 mailpieces per hour. A "dry-hole" is an empty space in the feed path of a mailpiece fabrication system. A dry-hole can be produced as a result of an operation requiring additional processing time, e.g., multi-sheet collation having a gate-fold configuration, or as a result of a processing error requiring that a piece of content material be out-sorted.

Figure 1:
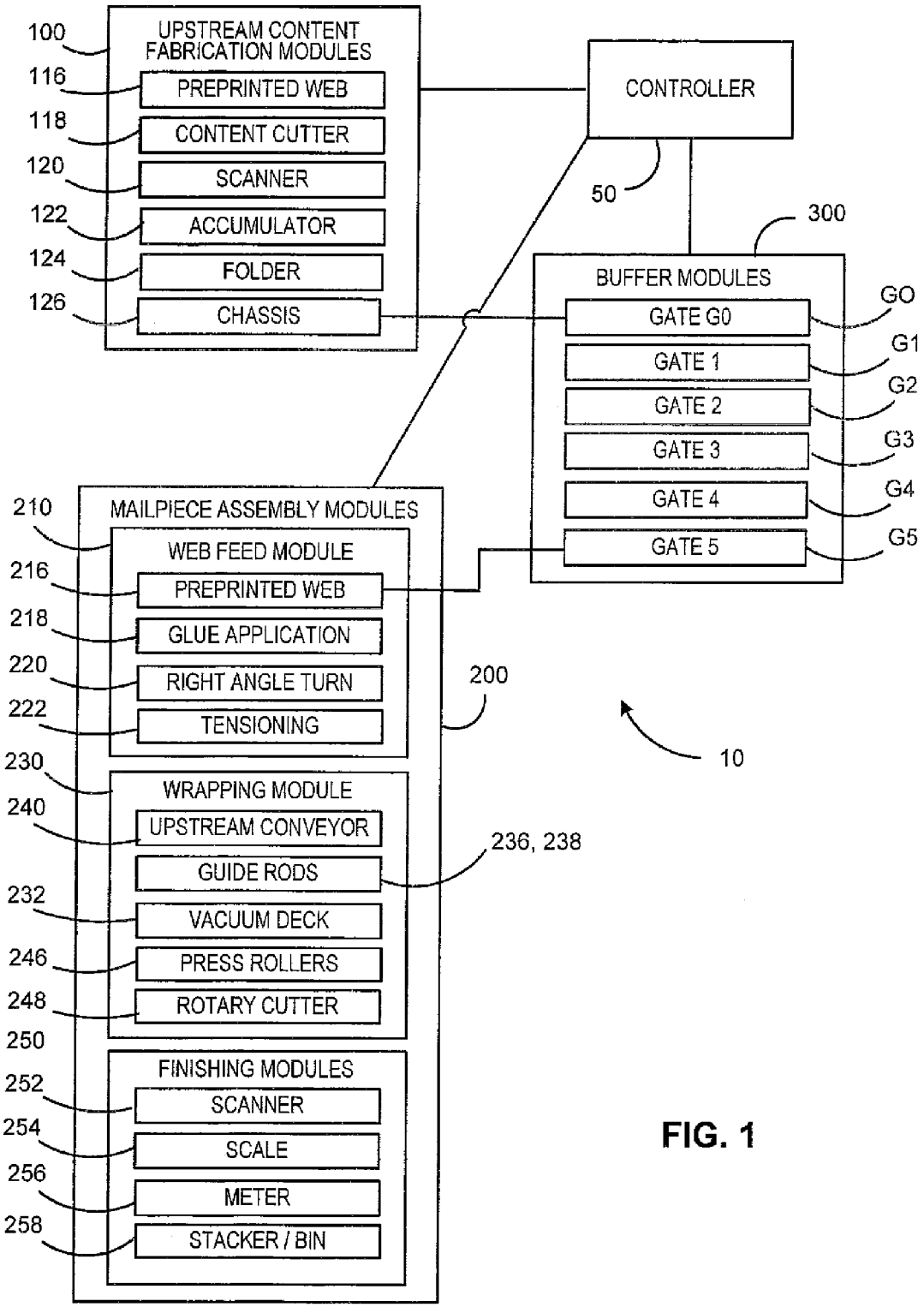
FIG. 1 is a schematic block diagram of the mailpiece creation system according to the present invention.
Figures 2, 2A:
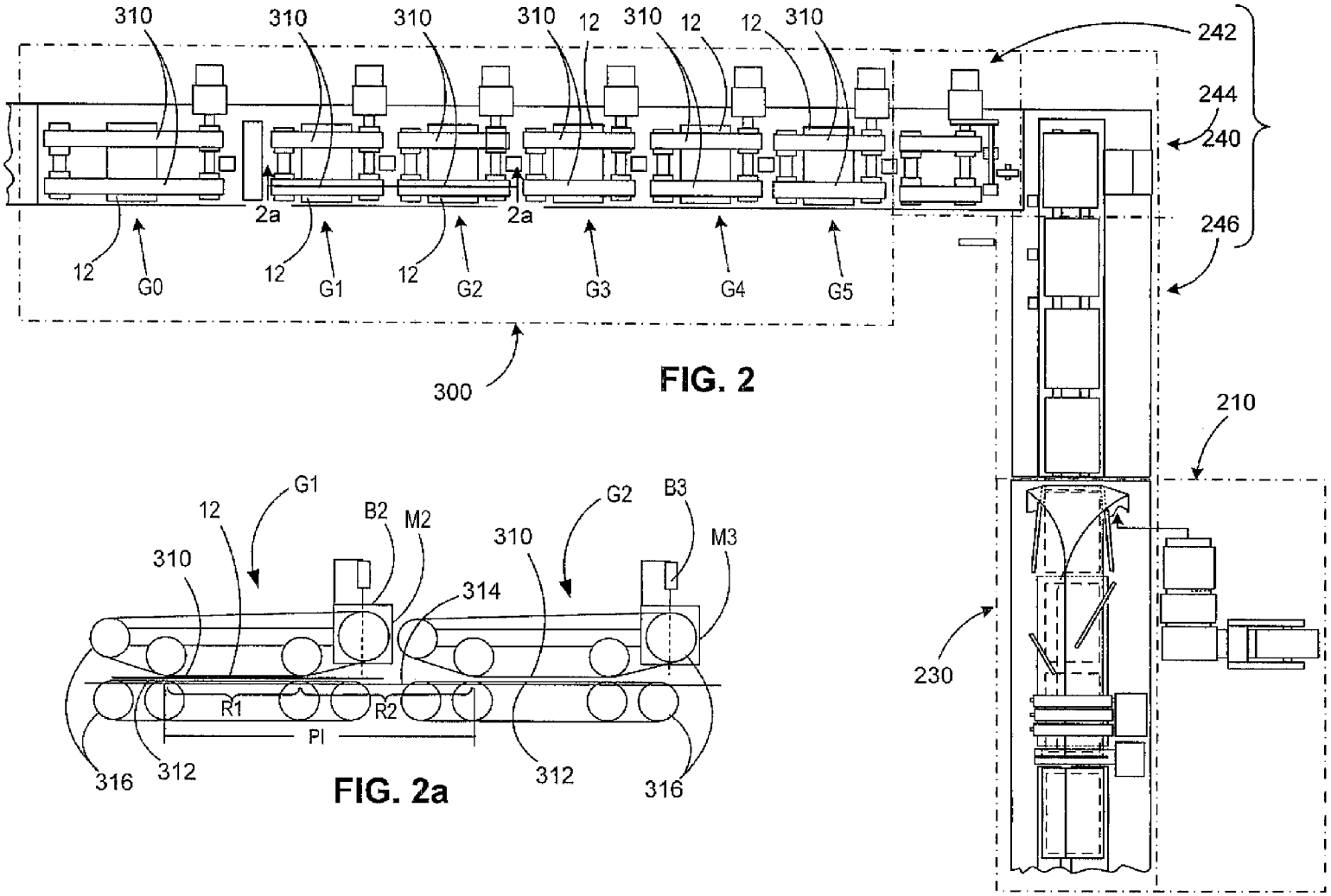
FIG. 2 is a broken-away schematic top view of the mailpiece creation system including a buffer module interposing an upstream content fabrication module and a downstream mailpiece assembly module.
FIG. 2*a* is a cross-sectional view taken substantially along line 2*a*-2*a* of FIG. 2 depicting the relevant details of two buffer gates of the buffer module.

Before discussing some of the more relevant components of the system and method of the present invention, a brief overview of the overall system will be provided. FIGS. 1 and 2 depict schematic block diagrams of a mailpiece creation system 10 according to the present invention wherein content material 12 is produced by a variety of upstream content fabrication modules 100 and finished by a variety of downstream mailpiece assembly modules 200. A buffer module 300 interposes the upstream and downstream modules 100, 200 while a system controller 50 is responsive to various system sensors/encoders B1-B9, E1-E7 to control the operation of all of the modules 100, 200, 300. While a single system processor 50 is depicted to control the various system modules 100, 200, 300, it should be appreciated that the mailpiece creation system 10 may be controlled by multiple processors which may integrated to perform the various system operations. Furthermore, it should be appreciated that only a small fraction of the total number of sensors/encoders are shown in the drawings and that many more system sensors are employed to monitor and control the system modules 100, 200, 300.

Upstream Content Fabrication Modules

In the described embodiment, the upstream content fabrication modules 100 include a first preprinted web 116 which contains the sheet material used to produce the mailpiece content material 12. The preprinted web 116 is supported by a rotating spool and paid-out to a content cutter 118. A conventional web-loop device, e.g., a vacuum-plenum box (not shown) may be disposed between the web 116 and the cutter 118 to prevent the web from tearing under high accelerations induced by conveyance rollers (not shown) of the content cutter 118.

Once cut, each sheet of content material 12 may be scanned to read information relating to the processing of a particular mailpiece. For example, a Beginning Of Collation (BOC) mark may be read by a scanner 120 to indicate that the current sheet is the first in a series of sheets which comprise a collation, i.e., the sheets which are part of the same mailpiece. These marks, also known as scan codes, are typically used to provide a plethora of processing information, e.g., whether the collation will be folded, stitched, or stapled.

Once scanned, the sheets of content material 12 may then be grouped in an accumulator module 122 to produce a stacked collation of content material 12. The stacked collation may then be conveyed to a folding module 124 to produce a folded collation. The folding module 124 manipulates the stacked collation around several press rollers to produce a bi-fold, C-fold, Z-fold or gate-fold configuration into the content material 12. As will be discussed in greater detail hereinafter, these operations may consume more than one cycle, hence, the distance between pieces of content material may vary from one cycle to several cycles depending upon the operations performed on the content during fabrication/assembly. As a result, a dry-hole may be created along the feed path of the mail run.

The content material 12 may then pass through a chassis module 126 where additional mailpiece content may be added by a series of overhead feeders (not shown). Inasmuch as the system controller 50 knows the specific processing requirements of each mailpiece and the location of each piece of content material 12 at any station along the feed path, the overhead feeders may selectively add inserts to build the content material 12. For example, a specific advertisement, targeted to one mailpiece recipient, may be added by one of the feeders, while a coupon offering may be added to the content material 12 of another mailpiece recipient.

Upstream content fabrication systems such as the type described above are produced by Pitney Bowes Inc., located in Stamford, Conn., a world-class leader in the manufacture of mailpiece inserters, sorters and mailpiece finishing equipment.

Downstream Mailpiece Fabrication Modules

Figure 5:
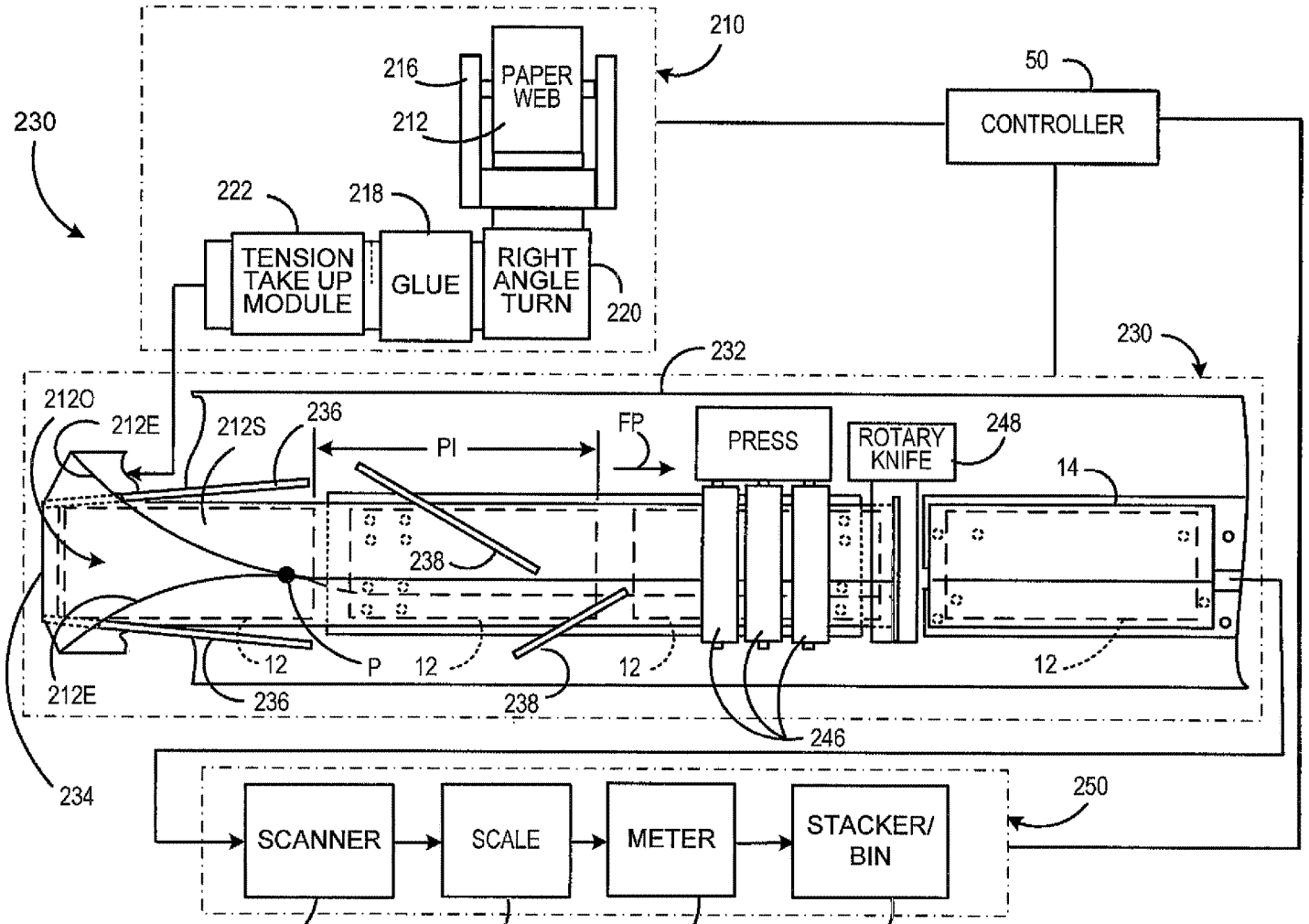
FIG. 5 is a schematic top view of the mailpiece fabrication module including an upstream conveyor, a mailpiece wrapper, a plurality of mailpiece finishing modules.

As content material 12 is completed by one or more of the upstream content fabrication modules 100, mailpieces are finished by one or more of the downstream mailpiece assembly modules 200. FIGS. 2 and 5 depict schematic top views of the downstream mailpiece assembly modules 200 including a web feed module 210, a wrapping module 230, and a plurality of mailpiece finishing modules 250. The web feed module 210 includes a second preprinted web 216 which comprises the sheet material used to wrap the content material 12, i.e., the wrapping material 212. More specifically, the wrapping material 212 of the preprinted web 216 may include a continuous two-dimensional flat pattern of material which, when cut and folded, forms a container for wrapping the content material 12. The wrapping material 212 may include the destination address of each mailpiece recipient printed on one panel while other another portion may include a pressure sensitive adhesive for encapsulating the content material 12. Alternatively, a glue application module 218 may apply adhesive to a face surface of the two-dimensional flat pattern in accordance with a predefined folding/cutting scheme of the wrapping material 212.

In the described embodiment, the web feed module 210 may include one or more Right Angle Turn (RAT) modules 220 to direct the wrapping material 212 to the wrapping module 230. Additionally, a tensioning module 222 interposes the web 216 and the wrapping module 230 to apply a predetermined tensile load on the wrapping material 212. Such tensile loads are conventionally imposed by one or more spring-biased rollers (not show) which support the wrapping material 212 in a serpentine arrangement. While the tensioning module 222 applies a predetermined load on the wrapping material 212, the principle method for controlling the loads on the wrapping material 212, is the buffer module 300 discussed in greater detail hereinafter.

The wrapping module 230 is adapted to convey the wrapping material 212 along a conveyance deck 232 while guiding the wrapping material 212 to form a flattened, tube-shaped, wrap 212S. More specifically, the wrapping material 212 is drawn upwardly (i.e., normal to the plane of the conveyance deck 232 shown in FIG. 5) and horizontally over a guide roller, or smooth guide surface 234, in the direction FP of the conveyance deck 232. As the wrapping material 212 is drawn over the guide roller 234, the edges 212E thereof are pulled across a pair of primary guide rods 236 to converge at a point P downstream of the guide roller 234. Secondary guide rods 238 may also be employed to augment the formation of the tube-shape wrap 212S as the wrapping material 212 is conveyed downstream of the guide roller 234.

As the wrapping material 212 is drawn together along the conveyance deck 232, the tube-shaped wrap 212S produces an open end 212O for accepting content material 12. That is, as the tube-shaped wrap 212S is formed, an internal surface 212S is exposed/available to accept the leading edge of each piece of content material 12.

In the described embodiment, the mailpiece finishing assembly modules 200 may include an upstream conveyor 240 to accept the content material 12 from the buffer modules 300 (described in greater detail below). The upstream conveyor 240 may include several modules including a content feed module 242, a feed path Right Angle Turn (RAT) module 244 and an input conveyor deck 246. While each module has a unique function, suffice it to say that these modules function to accept and deliver the content material 12 from the buffer module 300 to the open end of the wrapping module 230.

In the described embodiment, several pieces of content material 12 have been inserted into the tube-shaped wrap 212S and have been separated by a predefined pitch distance PI. Once wrapped, the tube-shaped wrap 212S and content material 12 are compressed by a triage of press rollers 246 and cut into individual mailpieces 14 by a rotary cutter 248. Thereafter, the individual mailpieces 14 are completed by a series of mailpiece finishing modules 250 which may include a scanner 252 to determine the size/volume of the mailpiece 14, a scale 254 to weigh the mailpiece 14, a meter 256 to apply a postage indicia based upon the size/weight of the mailpiece 14, and a stacker/bin 258 to sort the mailpieces 14 into one or more trays/containers (not shown).

Downstream mailpiece assembly systems such as the type described above are produced by Sitma Machinery S.p.A. located in Spilamberto, Italy, a world-class leader in the manufacture of mailpiece wrapping and finishing equipment.

Buffer Module

During the course of examining various ways to integrate paper-based wrapping systems with conventional mailpiece fabrication equipment, the inventors discovered that paper-based wrapping systems have certain inherent limitations which make the integration thereof with content fabrication systems of the prior art incompatible and/or highly problematic. These limitations where principally due to the inability to accelerate the large inertial mass of the wrapping material web 210, at or near, the accelerations achievable by conventional content fabrication modules 100. As such, throughput of a paper-based wrapping system can be less than one-half (½) of the throughput of conventional mailpiece inserters. Consequently, a solution was necessary for paper-based wrapping systems to compete in the marketplace with conventional mailpiece inserters.

Figures 3, 4:
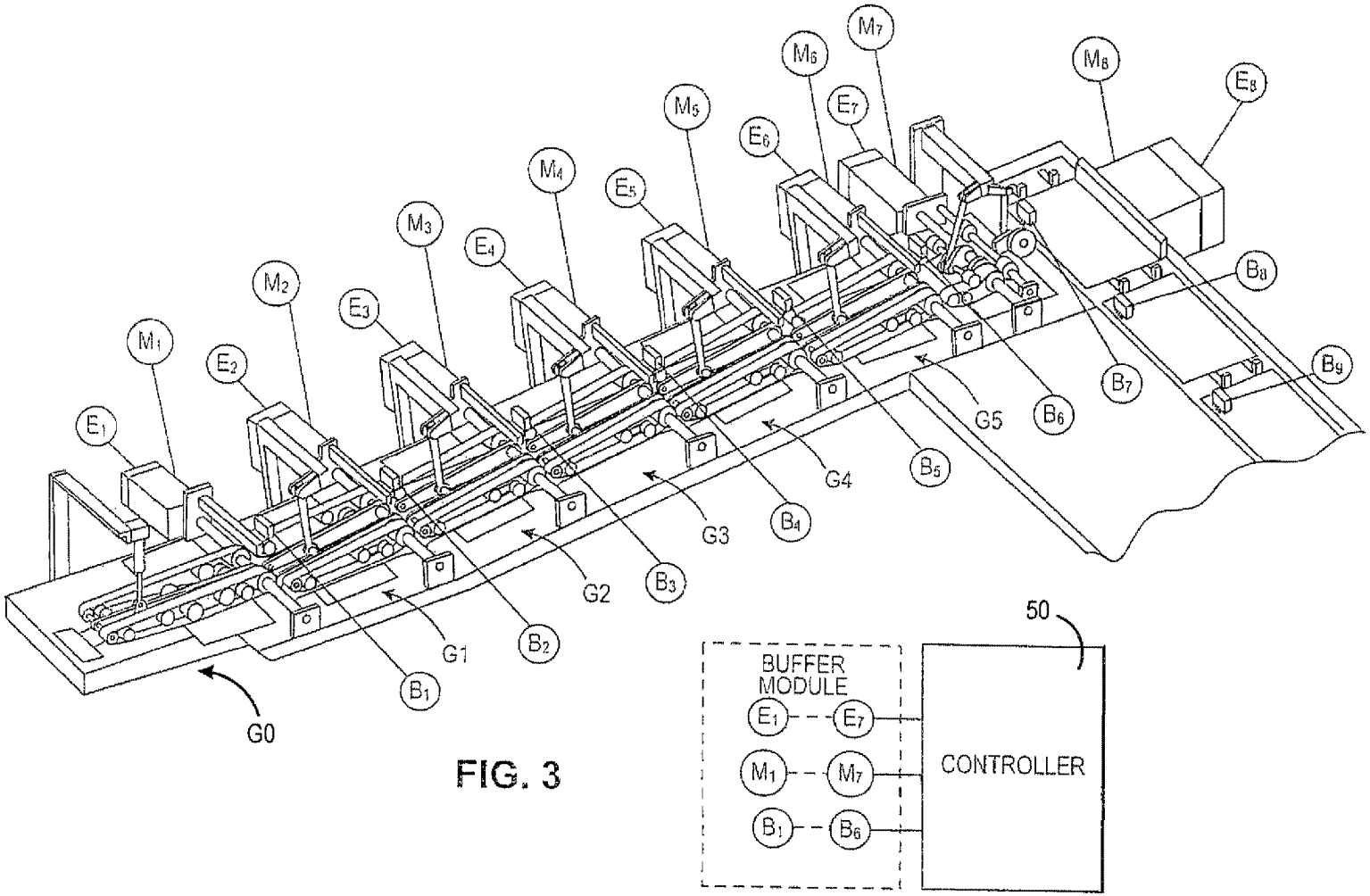
FIG. 3 is a broken away perspective view of the buffer module including six (6) buffer gates for dispensing content material to an upstream conveyor of the mailpiece assembly system.
FIG. 4 is a schematic view of a controller operatively coupled to a plurality of photocell and rotary encoder sensors for driving a plurality of buffer module motors.

The inventors discovered that a wrapping solution was achievable by an inter-machine buffer 300 disposed between the downstream mailpiece assembly module 200 and the upstream content fabrication modules 100. In FIGS. 2, 2*a* and 3, the buffer module 300 of the present invention includes a plurality of buffer gates G0-G5 disposed in serial arrangement between the upstream content fabrication modules 100 and the downstream mailpiece assembly modules 200. In the described embodiment, the buffer module 300 includes six (6) buffer stations comprising one (1) in-feed buffer gate G0 and five (5) buffer gates G1-G5. While six buffer gates G0-G5 are disclosed, as few as four (4) buffer gates may be employed as will be discussed in greater detail hereinbelow.

FIG. 2*a* depicts a cross-sectional view taken along line 2*a*-2*a* of FIG. 2 depicting adjacent buffer gates G1, G2 of the buffer module 300. Each of the buffer gates G1, G2 includes upper and lower transport elements having opposing belts 310, 312 (see FIG. 2*a*) for conveying content material 12 along a conveyance deck 314. The belts 310, 312 wrap around a plurality of rolling elements 316 and are commonly driven by a single drive motor.

Each of the gates G0-G5 is driven by motors M1-M6 which are individually controlled by the controller 50. Information regarding the motion of the transport elements 310, 312 of each of the gates G0-G5 is provided by a plurality of encoders E1-E6 which provide rotary position signals to the controller 50. Information regarding the position of the leading and/or trailing edge of each piece of content material 12, is provided by a plurality of photocells B1-B6 which provide position signals to the controller 50. Accordingly, position signals, both rotary and linear, are provided to the controller 50 to track the motion of content material 12 as each piece travels along the feed path of the buffer module 300. It should also be appreciated that similar encoders and photocells are provided throughout the mailpiece fabrication system 10 to monitor and track the location of each piece of content material and each mailpiece fabricated.

The length PI of each buffer gate G1, G2 is equal to the distance that a mailpiece will travel in one cycle or 250 millimeters. The length of the entire buffer module 300, i.e., from the in-feed buffer gate G0 to the final buffer gate G5, is between about 1.250 meters to 1.750 meters, and is preferably about 1.50 meters in length.

To define the length of a single buffer gate PI, the length from the second roller 316 of the first gate G1 to the second roller of the second gate G2 may be taken as the period length of the buffer gates G1-G5. Within this period length PI is a first region R1 of a buffer gate G1 wherein a piece of content material 12 is under the control of the upstream gate and a second region R2 wherein a piece of content material 12 is under the control of both the upstream and downstream gates G1 and G2. The import of the first and second regions will become apparent when discussing the operation of the mailpiece fabrication system 10 and the buffer module 300.

In the broadest sense of the invention, the buffer module 300 is governed by a control algorithm which ensures that the wrapping module 230 is not exposed to accelerations which may rupture, tear or fail the wrapping material 212. While the control algorithm is most accurately related to the maximum allowable tensile stress of the wrapping material 212, the method of control and control algorithms will be described in terms of threshold velocities/acceleration to eliminate the requirement to address the inertia functions/cross-sectional area of a material.

To meet the foregoing criteria, the system and method of the present invention determines a threshold level of acceleration which is acceptable for handling the wrapping material 212S of the wrapping module 230. That is, to the extent that the wrapping material 212S follows a convoluted/tortuous path from the pre-printed web 216 to the conveyance deck 232, it is necessary to determine the changes in velocity, i.e., acceleration, which may be handled without tearing, wrinkling or otherwise distorting the material during use. In the described embodiment, it was determined that a threshold level of acceleration of below about 0.5 g's of acceleration, and preferably below about 0.4 g's of acceleration, be maintained in the wrapping module 230 to mitigate failure of, or other difficulties associated with, handling the wrapping material 212. Furthermore, it was determined that, to coordinate the acceleration/deceleration of the wrapping module 230 with the upstream mailpiece fabrication modules 100, it would be necessary to accelerate/decelerate the wrapping module 230 over the course of about 500 millimeters, or 0.500 meters, in about 0.28 seconds or, over a length of about two buffer gates (recalling that a buffer gate is about 250 millimeters in length).

Accordingly, for the wrapping module to (i) decelerate from a maximum velocity to zero, and to once again, (ii) accelerate from a stop to the maximum velocity, the buffer module 300 must include at least four (4) buffer gates, i.e., (2) two buffer gates to decelerate the wrapping module, and (2) two buffer gates to accelerate the wrapping module, meet the criteria associated with the threshold acceleration. While it was determined that a minimum of four (4) buffer gates was necessary to properly coordinate the acceleration of the wrapping module 230 with the upstream content fabrication modules 100, e.g., the chassis module 126, it was also determined that a greater number of buffer gates provides additional length to smooth the delivery of content material 12 to the downstream mailpiece assembly modules 200. Consequently, it was determined that a total of six (6) buffer gates G0-G5 spanning a distance of 1.500 meters be employed to optimize the throughput of the mailpiece fabrication system 10.

In operation, each of the buffer gates G0-G5 is autonomously controlled and certain conditions must be met before the conveyance velocity of any individual buffer gate is changed. Firstly, it should be appreciated that the velocity of one buffer gate is dependent upon the velocity of a buffer gate immediately downstream of the buffer gate. Secondly, each buffer gate is driven such that the error in pitch distance, i.e., the error between a desired pitch distance and the actual measured pitch distance (measured using the photocell sensors B1-B6) is driven to a zero value. For example, if the pitch distance from the leading edge of the last piece of content material to the leading edge of the current piece of content material is 270 millimeters i.e., the actual measured pitch distance, and the desired pitch distance is 250 mm, then the pitch error is 20 millimeters, i.e., the difference between or 270 mm-250 mm. This type of control algorithm is known as a "pitch control" algorithm inasmuch as the error in pitch distance is driven to zero as the content material 12 moves from an upstream buffer gate, e.g., 01, to a downstream buffer gate e.g., G2. Thirdly, it should be appreciated that in order to accelerate/decelerate a piece of content material 12 within a gate, the content material 12 must be within the predefined first region R1 of the buffer gate (see FIG. 2*a*). This first region R1 is centrally disposed relative to each end of the respective buffer gate. If, on the other hand, a piece of content material 12 is located within the second region R2 which spans adjacent buffer gates G1 and G2 (i.e., the leading edge of the content material 12 is under a downstream belt G2 while the trailing edge is under an adjacent upstream belt G1), then the content material 12 may not be accelerated/decelerated by either of the buffer gates G1, G2. This logic is invoked to prevent the piece of content material 12 from being pulled-apart, or pushed-together/crushed, when the content material 12 is under the control of two adjacent buffer gates G1, G2.

While the buffer gates G0-G4 are principally governed by a pitch control algorithm such as that described above, the last, or downstream buffer gate G5 (i.e., the gate which delivers content material 12 to the wrapping module 230), is controlled by an intercept profile/algorithm. Like the pitch control algorithm described above, an intercept algorithm is a term of art and does not require a lengthy description. However, suffice to say that intercept profile/algorithm effects a zero pitch error signal when the content material reaches its final destination on the upstream conveyor 240 of the wrapping module 230. It should also be appreciate that the intercept algorithm is only invoked under conditions wherein the difference between the velocity of the feed module 242 of the upstream conveyor 240 is greater than a threshold speed, e.g., greater than zero, and the difference in velocity between the content feed module 242 and the downstream buffer gate G5 is within a threshold range, e.g., 1 mm/s. If these conditions are not met, i.e., the content material will not be precisely located within a pocket of the upstream conveyor 240, the controller 50 cues the mailpiece fabrication system 10 to abort or shut down to prevent downstream errors and/or jams.

In summary, the present invention integrates a mailpiece fabrication assembly system, i.e., one which employs a mailpiece wrapping module with a content material fabrication system, e.g., a chassis module with overhead feeders to build the content material. The system and method of the present invention employs a buffer module to accommodate the significant differences in acceleration between the upstream and downstream modules. Furthermore, the buffer module employs a plurality of serially arranged buffer gates to fill "dry-holes" which are routinely created by the upstream content fabrication modules. Finally, the system and method optimizes throughput will maintaining the reliability and integrity of the mailpiece fabrication system.

It is to be understood that all of the present figures, and the accompanying narrative discussions of preferred embodiments, do not purport to be completely rigorous treatments of the methods and systems under consideration. For example, while the invention describes an interval of time for completing a phase of sorting operations, it should be appreciated that the processing time may differ. A person skilled in the art will understand that the steps of the present application represent general cause-and-effect relationships that do not exclude intermediate interactions of various types, and will further understand that the various structures and mechanisms described in this application can be implemented by a variety of different combinations of hardware and software, methods of escorting and storing individual mailpieces and in various configurations which need not be further elaborated herein.

The invention claimed is:

1. A system for wrapping sheet material to produce finished mailpieces, comprising:

an upstream content fabrication module for conveying content material along a feed path;

a downstream mailpiece assembly module including a wrapping module having wrapping material therein and adapted to convey a web of sheet material along a downstream conveyance deck, the wrapping module adapted to encapsulate the content material in a tube-shaped wrap to produce wrapped mailpieces; and a buffer module including a plurality of buffer gates disposed in serial arrangement and interposing the upstream content fabrication module and the downstream mailpiece assembly modules, the buffer gates adapted to convey the content material from an upstream buffer gate to a downstream buffer gate to maintain a threshold pitch distance between pieces of content material; and a controller, operatively coupled to the upstream content fabrication module, the downstream mailpiece assembly module and the buffer module, the controller operative to control the conveyance of the content material through the buffer gates to coordinate the delivery and insertion of the content material into the tube-shaped wrap consistent with an acceleration profile in the wrapping module that maintains acceleration of the wrapping material below a threshold level and includes both an acceleration cycle and a deceleration cycle whereby damage to the wrapping material is prevented with the wrapping module.

2. The system according to claim 1 wherein the buffer module includes a downstream buffer gate and an upstream buffer gate, each of the buffer gates including position sensors for detecting an edge position of each piece of content material, and wherein the controller determines an error signal between a desired pitch distance and an actual pitch distance as measured by the position sensors of each gate.

3. The system according to claim 1 wherein buffer module includes at least four (4) buffer gates.

4. The system according, to claim 1 wherein the buffer module includes at least six (6) buffer gates.

5. The system according to claim 1 wherein each of the upstream content fabrication modules drive content material along a conveyance deck at a first velocity and wherein each of the downstream mailpiece assembly modules drive wrapping material of the wrapping module along a conveyance deck at a second velocity and wherein the controller is operative to match the first and second velocities to optimize throughput.

6. The system according to claim 2 wherein each of the buffer gates drives content material along a conveyance deck at a velocity, wherein the velocity of an upstream buffer gate is dependent upon the velocity of a buffer gate immediately downstream of the upstream buffer gate and wherein the controller drives the velocity of the upstream buffer gate to minimize an error in pitch distance between a desired pitch distance and an actual pitch distance.

7. The system according to claim 1 wherein the buffer module includes a downstream buffer gate for conveying content material to the wrapping module and at least one upstream buffer gate for conveying content material to the downstream buffer gate, the upstream buffer gate being controlled by a pitch control algorithm and the downstream buffer gate being controlled by an intercept control algorithm.

8. The system according to claim 1 wherein the threshold level is about 0.5 g's of acceleration.

9. A method for integrating a mailpiece fabrication system having an upstream content fabrication system and a downstream mailpiece assembly system, the upstream content fabrication system including a chassis module having a plurality of overhead feeders to build content material and the downstream mailpiece assembly system having a wrapping module including wrapping material for wrapping the content material to produce finished mailpieces, comprising the steps of:

operating the wrapping module in accordance with acceleration profile that maintains acceleration of the wrapping material below a threshold level and includes both an acceleration cycle and a deceleration cycle whereby damage to the wrapping material is prevented within the wrapping module, and buffering the conveyance of the content material through buffer gates to coordinate the delivery and insertion of the content material into the wrapping material consistent with the acceleration profile.

10. The method according to claim 9 wherein the step of buffering the content material includes buffering content material in at least four (4) buffer gates.

11. The method according to claim 9 wherein the step of buffering the content material includes buffering the content material in at least six (6) buffer gates.

12. The method according to claim 11 further comprising the step of including the step of controlling the velocity of the chassis module to match the velocity of the wrapping module.

13. The method according to claim 12 further comprising the step of controlling the velocity of an upstream buffer gate based upon the velocity of a downstream buffer gate, and controlling the velocity of each to minimize an error in the pitch distance from a desired pitch distance to an actual pitch distance between pieces of content material.

* * * * *